US010779578B2

(12) United States Patent
Van Tiel et al.

(10) Patent No.: US 10,779,578 B2
(45) Date of Patent: Sep. 22, 2020

(54) FOOTLET AS WELL AS A METHOD FOR PRODUCING SUCH A FOOTLET

(71) Applicant: STEPS HOLDING B.V., Middelbeers (NL)

(72) Inventors: Cornelius Hendrikus Nicolaas Van Tiel, Middelbeers (NL); Wilhelmus Jaxobus Cornelius Van Tiel, Middelbeers (NL)

(73) Assignee: STEPS HOLDING B.V., Middelbeers (NL)

( * ) Notice: Subject to any disclaimer, the term of this patent is extended or adjusted under 35 U.S.C. 154(b) by 148 days.

(21) Appl. No.: 15/518,326

(22) PCT Filed: Oct. 6, 2015

(86) PCT No.: PCT/EP2015/073019
§ 371 (c)(1),
(2) Date: Apr. 11, 2017

(87) PCT Pub. No.: WO2016/058864
PCT Pub. Date: Apr. 21, 2016

(65) Prior Publication Data

US 2017/0303600 A1 Oct. 26, 2017

(30) Foreign Application Priority Data

Oct. 17, 2014 (NL) ..... 2013644

(51) Int. Cl.
*A41B 11/12* (2006.01)
*D04B 1/26* (2006.01)

(52) U.S. Cl.
CPC ..... *A41B 11/121* (2013.01); *A41B 11/128* (2013.01); *D04B 1/26* (2013.01)

(58) Field of Classification Search
CPC ... A41B 11/121; A41B 11/128; A41B 11/008; A41B 11/007; A41B 11/12; A41B 11/123; A41B 11/126; A43B 1/04; D04B 1/26
(Continued)

(56) References Cited

U.S. PATENT DOCUMENTS 2,001,293 A * 5/1935 Wilson ..... A43B 1/04 66/171
2,333,373 A * 11/1943 Grey ..... D04B 1/106 66/171

(Continued)

FOREIGN PATENT DOCUMENTS

CN 101646817 A 2/2010
CN 202603618 U 12/2012

(Continued)

OTHER PUBLICATIONS

European Office Action dated Mar. 14, 2018 and issued in connection with Patent Application No. 15775682.6.

(Continued)

*Primary Examiner* — Alissa L Hoey
(74) *Attorney, Agent, or Firm* — Barnes & Thornburg LLP

(57) ABSTRACT

A footlet is provided with a heel portion formed by knitting, a toe portion, and a middle portion located between the heel portion and the toe portion. The middle portion comprises lateral sides that extend between the heel portion and the toe portion on either side. The heel portion is provided with a knitted elastic band forming an edge, which is provided with an anti-slip element applied thereto on a side facing the toe portion. The anti-slip element has been applied to the elastic band after the knitting of at least the elastic band.

13 Claims, 4 Drawing Sheets

(58) Field of Classification Search
USPC ..... 2/239
See application file for complete search history.

(56) References Cited

U.S. PATENT DOCUMENTS

| | | | | | |
|---|---|---|---|---|---|
| 2,344,773 | A * | 3/1944 | Herbert | D04B 1/106 | 36/10 |
| 2,514,108 | A * | 7/1950 | Vogt | A41B 11/128 | 2/239 |
| 2,623,374 | A * | 12/1952 | Hinchman | D04B 1/106 | 66/182 |
| 2,724,195 | A * | 11/1955 | Luchs | A43B 23/28 | 36/10 |
| 2,748,397 | A * | 6/1956 | Stolzenberg | A41B 11/12 | 2/240 |
| 2,848,885 | A * | 8/1958 | Goodman | D04B 1/26 | 66/171 |
| 3,146,468 | A * | 9/1964 | McDonald | A41B 11/121 | 2/239 |
| 3,255,613 | A * | 6/1966 | Burd | A41B 11/12 | 66/172 R |
| 3,274,804 | A * | 9/1966 | Thorneburg | D04B 1/108 | 66/171 |
| 3,289,329 | A * | 12/1966 | Weiss | A41B 11/00 | 36/10 |
| 3,315,276 | A * | 4/1967 | Daxe | A41B 11/00 | 2/239 |
| 3,600,909 | A * | 8/1971 | Kaplan | D04B 1/106 | 66/171 |
| 3,800,331 | A * | 4/1974 | Taddeo | A41B 11/12 | 2/240 |
| 3,906,753 | A * | 9/1975 | Siegfried | D04B 1/24 | 66/170 |
| 3,990,115 | A * | 11/1976 | Nester | A41B 11/00 | 2/239 |
| 4,150,498 | A * | 4/1979 | Palmer | A43B 3/106 | 2/239 |
| 4,194,249 | A * | 3/1980 | Thorneburg | A41B 11/003 | 2/239 |
| 4,282,727 | A * | 8/1981 | Dunlap | D04B 1/26 | 66/172 E |
| 4,630,455 | A * | 12/1986 | Lingenfelter | D04B 1/106 | 2/239 |
| 4,728,538 | A * | 3/1988 | Kaspar | D06M 17/06 | 118/202 |
| 5,428,975 | A * | 7/1995 | Lee, III | A41B 11/00 | 2/239 |
| 5,497,513 | A * | 3/1996 | Arabeyre | A61F 13/08 | 2/16 |
| 6,457,332 | B1 * | 10/2002 | Schiavello | D04B 1/108 | 66/8 |
| 6,673,421 | B1 | 1/2004 | Andrews et al. | | |
| 10,227,717 | B2 * | 3/2019 | Pedrini | D04B 9/46 | |
| 2006/0179546 | A1 * | 8/2006 | Ko | A41B 11/04 | 2/239 |
| 2006/0260024 | A1 | 11/2006 | Lee | | |
| 2010/0037370 | A1 * | 2/2010 | Busi | D04B 1/108 | 2/239 |
| 2010/0081984 | A1 * | 4/2010 | Coffinardi | A41B 11/126 | 602/63 |
| 2010/0281602 | A1 * | 11/2010 | Stabile | A41B 11/128 | 2/239 |
| 2013/0055767 | A1 * | 3/2013 | Busi | D04B 1/26 | 66/187 |
| 2014/0013487 | A1 * | 1/2014 | Montgomery | A41B 11/00 | 2/239 |
| 2014/0088523 | A1 * | 3/2014 | Ottuso | A61M 35/00 | 604/293 |
| 2014/0115749 | A1 * | 5/2014 | Weinman | A41B 11/008 | 2/158 |
| 2014/0250568 | A1 * | 9/2014 | MacDonald | A41B 11/008 | 2/239 |
| 2015/0052663 | A1 * | 2/2015 | Stallworth | A43B 1/0081 | 2/239 |
| 2016/0029704 | A1 * | 2/2016 | Jung | A41B 11/00 | 2/239 |
| 2016/0167344 | A1 * | 6/2016 | Arici | C09J 153/025 | 2/115 |
| 2016/0219941 | A1 * | 8/2016 | Hara | A41B 11/008 | |
| 2018/0084839 | A1 * | 3/2018 | Neal | A41B 11/02 | |

FOREIGN PATENT DOCUMENTS

| | | | | |
|---|---|---|---|---|
| CN | 203692560 | U | 7/2014 | |
| DE | 1610580 | A1 | 8/1971 | |
| GB | 1208025 | A | 10/1970 | |
| JP | H0669205 | U | 9/1994 | |
| JP | 2014034734 | A | 2/2014 | |
| JP | 2014133952 | A | 7/2014 | |
| WO | WO-2008006525 | A1 * | 1/2008 | A41B 11/008 |
| WO | 2008072048 | A1 | 6/2008 | |
| WO | 2008105003 | A1 | 9/2008 | |
| WO | WO-2010037989 | A1 * | 4/2010 | A41B 11/008 |
| WO | 2013152211 | A2 | 10/2013 | |

OTHER PUBLICATIONS

Chinese Office Action dated Apr. 24, 2018 and issued in connection with Chinese Patent Application No. 201580055445.2.

International Preliminary Report on Patentability, International Application No. PCT/EP2015/073019, dated Apr. 18, 2017, 6 pages.

PCT International Search Report and Written Opinion completed by the ISA/EP dated Nov. 25, 2015 and issued in connection with PCT/EP2015/073019.

Russian Official Action issued in connection with Russian Patent Application No. 2017116996.

* cited by examiner

FOOTLET AS WELL AS A METHOD FOR PRODUCING SUCH A FOOTLET

CROSS-REFERENCE TO RELATED APPLICATIONS

This application is a national stage entry under 35 USC § 371(b) of PCT International Application No. PCT/EP2015/073019, filed on Oct. 6, 2015, and claims the benefit of Netherlands Patent Application No. 2013644, filed on Oct. 17, 2014, both of which are expressly incorporated by reference herein.

FIELD OF THE INVENTION

The invention relates to a footlet provided with a heel portion formed by knitting, a toe portion, and a middle portion located between the heel portion and the toe portion, which middle portion comprises lateral sides that extend between the heel portion and the toe portion on either side, wherein the heel portion is provided with a knitted elastic band forming an edge.

The invention also relates to a method for producing such a footlet.

BACKGROUND OF THE INVENTION

Such a footlet, which is known from WO2008072048A1, is used for partly covering a person's foot. The footlet, when worn, extends over the heel, the lower side of the foot and over the toes. The middle portion then also extends somewhat along the lateral sides of the foot. The upper side of the foot is not covered by the footlet, or only in part. When partially open shoes are worn, the footlet is hidden from view by the shoe and affords the wearer a comfortable feeling. The elastic band presses the heel portion against the person's heel.

A drawback of the known footlet is the fact that there is a risk of the footlet being shifted off the foot during walking by the frictional contact between the heel portion and the inner side of the shoe, which is undesirable.

DESCRIPTION OF THE INVENTION

The invention has for its object to provide a footlet which is easy to produce and which will remain firmly in contact with the foot in use.

This object is achieved with the footlet according to the invention in that the elastic band of the heel portion is provided with an anti-slip element applied thereto on a side facing the toe portion, which anti-slip element has been applied to the elastic band after the knitting of at least the elastic band.

A footlet exhibiting a higher coefficient of friction between a person's foot and the heel portion is obtained in a simple manner by the provision of the anti-slip element on the elastic band, so that the risk of the footlet sliding off the foot is reduced.

The elastic band firmly presses the anti-slip element against the person's heel, thereby further enhancing the anti-slip effect of the anti-slip element. By applying the anti-slip element to the elastic band, both the elastic effect of the elastic band and the anti-slip effect of the anti-slip element of the footlet are enhanced.

The anti-slip element is completely or substantially completely hidden from view by the elastic band during use of the footlet.

In the footlet, the heel portion and in particular the elastic band has an essentially different function from the toe portion. The heel portion abuts against the heel of the person wearing the footlet and must be prevented from sliding off the heel. Because of its shape, the toe portion will stay in place around the front part of the foot without sliding off. The toe portion can also cover the upper side of the foot for the larger part. Furthermore, the force applied to the heel must not be so great that the elastic band will painfully press into the heel portion. In contrast to common socks and stockings, which are usually made for every individual shoe size or two shoe sizes, footlets are usually made in only two or three sizes. This has the advantage that little shelf space is needed in a shop and stock control is easy. The consequence is, however, that the footlets must be suitable for use with a relatively large range of foot sizes and must comfortably fit any foot size. Because of the presence of the anti-slip element, less force needs to be applied to the heel by the elastic band than in the absence of such an anti-slip element. As a result, the elastic band will not painfully press into the heel, even when the footlet is worn on a relatively large foot. The anti-slip element will prevent the heel portion from sliding off the foot, however. In addition to that, the relatively soft anti-slip element ensures that the elastic band will comfortably abut against the heel.

It is noted that WO2008105003A1 discloses a sock which has a circular opening at an upper side. Near the circular opening, the sock is provided with a continuous ring-shaped silicon band, so that the silicon band will extend over the entire circumference of the leg in use. Because the silicon band extends over the entire circumference, a high slip resistance is obtained. The silicone band is located under a folded edge of the sock. Because of this, undesirable sliding down of the folded edge is possible.

It is noted that US20060260024A1 discloses a sock provided with anti-slip material near a ring-shaped upper edge.

In both the above cases, leaving out anti-slip material over more than half or an even larger portion of the circumference of the sock would lead to the sock sliding down over that part of the leg, resulting in a crooked position of the sock on the leg and thus to an untidy appearance, which is undesirable, of course. Both documents thus teach that the anti-slip material must extend over the entire circumference of the ring-shaped edge.

In the footlet according to the invention, the anti-slip element of the heel portion preferably extends over only at least part of the heel of the person wearing the footlet.

It is also possible, however, to provide the toe portion with an anti-slip element. The heel portion and the toe portion must be symmetrical in that case. This has the advantage that the footlet can also be worn the other way around, as it were, with the toe portion being used as the heel portion and conversely.

The lateral sides extending between the heel portion and the toe portion are not provided with an anti-slip element.

It is noted that footlets are known wherein an anti-slip element is provided on the inner side of the footlet. Such anti-slip elements are provided spaced from the upper side of the heel portion, so that the section of the heel portion that is located between the upper side thereof and the anti-slip element can still slide down.

In the footlet according to the invention, the anti-slip element is better hidden from view by the elastic band, which is usually made of a less translucent material than the rest of the heel portion, resulting in a more attractive appearance of the footlet when worn.

One embodiment of the footlet according to the invention is characterised in that only the elastic band of the heel portion is provided with an anti-slip element applied thereto on a side facing the toe portion.

The anti-slip element thus only abuts against the heel of the person wearing the footlet and the toe portion covering the toes and possibly the instep is not provided with an anti-slip element. The amount of material needed for the anti-slip element is thus limited, as are the costs therefor.

Since the shape of the heel of a foot is essentially different from the toe portion, the heel portion and the toe portion are configured essentially differently as well. The heel portion and the toe portion are asymmetrical. The provision of the anti-slip element only on the heel portion makes it even clearer to a user which part of the footlet is the heel portion and which part is the toe portion.

Another embodiment of the footlet according to the invention is characterised in that the elastic band is folded in two, with the elastic band comprising a first band portion facing the toe portion and a second band portion remote from the toe portion, wherein the first band portion facing the toe portion is provided with the anti-slip element.

Since the elastic band is folded, the elastic effect of the band is further enhanced and a relatively thick, firm band is obtained. The folded elastic band completely or substantially completely hides the anti-slip element from view when worn.

Another embodiment of the footlet according to the invention is characterised in that the anti-slip element comprises silicones.

Silicones can be in contact with the foot for long periods without causing irritation. In addition, silicones are flexible so that they can be readily deformed along with the footlet when the latter is slipped over a person's foot.

Another embodiment of the footlet according to the invention is characterized in that the anti-slip element is strip-shaped.

Such a strip-shaped anti-slip element can be applied to the elastic band in a simple manner.

Another embodiment of the footlet according to the invention is characterised in that the anti-slip element comprises a number of spaced-apart anti-slip parts.

By using a number of spaced-apart anti-slip parts, an anti-slip element that extends over a relatively great length of the elastic band can be obtained using a relatively small amount of material, such as silicone. The costs for the anti-slip element are thus limited.

Another embodiment of the footlet according to the invention is characterised in that the anti-slip parts are spaced 5-10 mm apart.

Such a spacing between the anti-slip parts provides a sufficient anti-slip effect, whilst on the other hand a saving on the amount of material needed for the anti-slip element is realised.

Another embodiment of the footlet according to the invention is characterised in that the anti-slip parts of block-shaped or dot-shaped.

Such shapes are easy to apply to the elastic band by means of a stencil, a screen or by heat transfer. Dot-shaped anti-slip parts can also be applied in a simple manner by means of a dispenser.

Another embodiment of the footlet according to the invention is characterised in that the anti-slip element extends along a length of 2-7 cm over the elastic band.

When the footlet is worn and the elastic band is stretched, such a length of the anti-slip element of the footlet (when not worn) provides an anti-slip element which extends over at least 45 degrees, and preferably 90 degrees, of the heel.

Another embodiment of the footlet according to the invention is characterised in that the anti-slip element extends over the elastic band over a width of 2-6 mm transversely to the length.

Such a width provides a good anti-slip effect. Preferably, the anti-slip element extends over substantially the entire height of the elastic band, wherein a sufficient spacing from the edge near the upper side of the elastic band is to be maintained in order to prevent the anti-slip element from showing when worn.

Another embodiment of the footlet according to the invention is characterised in that the footlet is entirely made by reciprocating knitting and that subsequently the anti-slip element is applied to the elastic band.

In this way a footlet can be made in one piece without any stitched seams and subsequently be provided with the anti-slip element.

The invention also relates to a method for producing such a footlet, wherein, after at least the elastic band of the heel portion has been knitted, the elastic band is provided with an anti-slip element applied thereto on a side facing the toe portion.

Due to the combination of the elastic band and the anti-slip element thus provided thereon, a footlet is obtained which will remain firmly in contact with the foot at the desired position when worn.

One embodiment of the method according to the invention is characterised in that the anti-slip element is applied to the elastic band by means of screen-printing, template printing, heat transfer or by means of a dispenser.

Using such techniques, any desired shape of the anti-slip element can be applied to the elastic band in any desired thickness in a simple and accurate manner. When heat transfer is used, a strip of a techno-polymer tape can for example be transferred from a carrier tape to the elastic band in a simple manner. Such a techno-polymer tape is for example Faitplast With Me, which has good friction-enhancing properties, so that shifting of the footlet is prevented in a simple manner.

Another embodiment of the footlet according to the invention is characterised in that a stretching force is applied the elastic band prior to the application of the anti-slip element, as a result of which the elastic band is stretched from a starting length to a length 1.5-3 times greater than the starting length, and that subsequently the anti-slip element is applied, after which the stretching force is released.

In this way the anti-slip element is applied in a stretched situation that is comparable to a footlet when worn. In this way it is ensured that sufficient material is provided for forming the anti-slip element when the footlet is worn. Furthermore, the material of the anti-slip element can thus penetrate the elastic band better than in the situation in which the band is not stretched, so that a better bond between the anti-slip element and the elastic band is obtained.

Another embodiment of the footlet according to the invention is characterised in that the footlet is entirely made by reciprocating knitting, after which the anti-slip element is applied to the elastic band.

In this way a footlet can be made in one piece without any stitching seems and subsequently be provided with the anti-slip element.

BRIEF DESCRIPTION OF THE FIGURES

The invention will now be explained in more detail with reference to a drawing, in which.

Like parts are indicated by the same reference numerals in the figures.

DETAILED DESCRIPTION OF THE FIGURES

Figure 1:
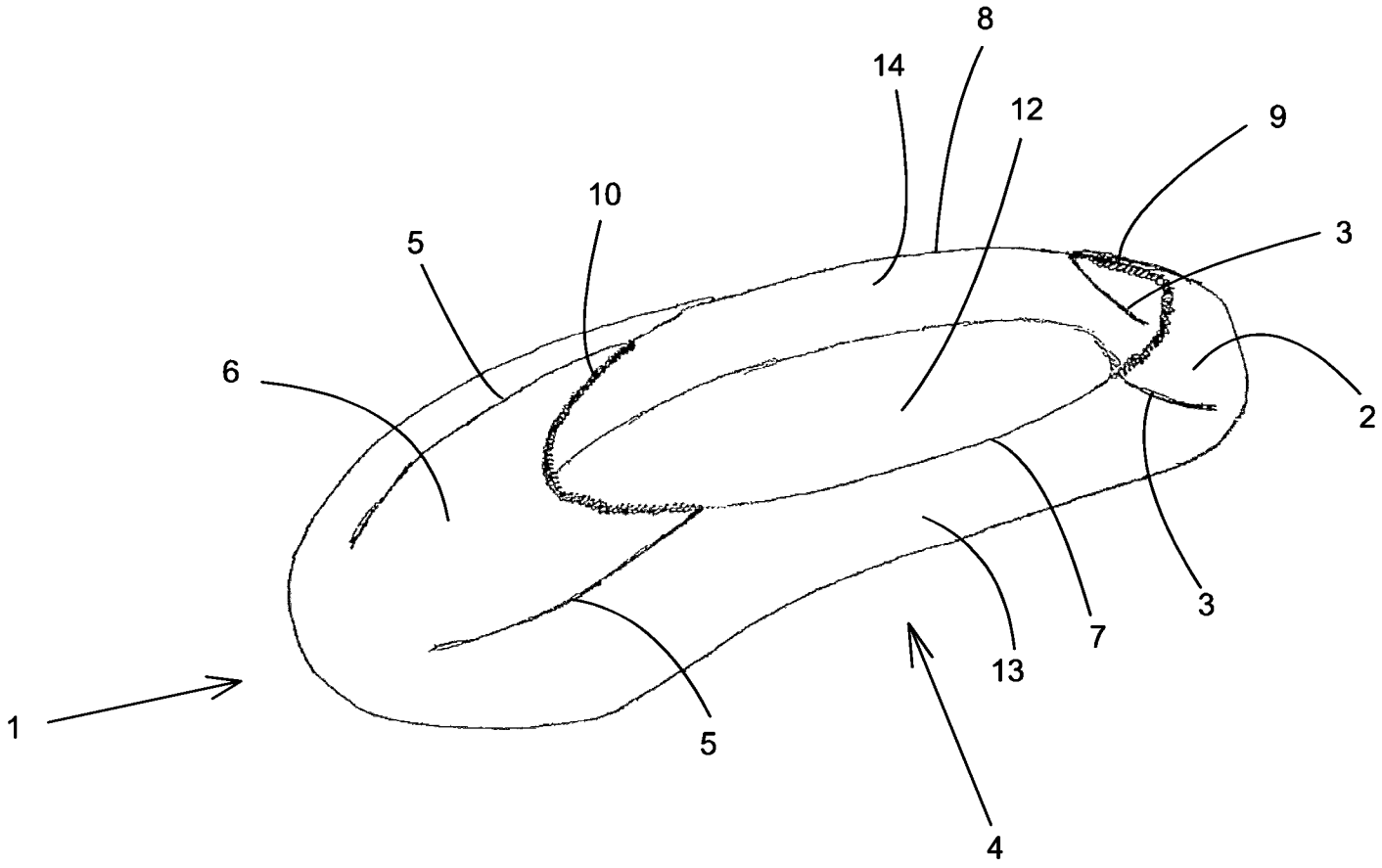
FIG. 1 is a perspective view of a footlet according to the invention.

FIG. 1 shows a footlet 1 according to the invention made on a knitting machine with reciprocating knitting movements only.

The footlet 1 is provided with a heel portion 2, a middle portion 4 connected to the heel portion 2 via lines 3 formed by knitting, and a toe portion 6 connected to the middle portion 4 via lines 5 formed by knitting. The desired shape of the footlet 1 can be obtained by increasing and decreasing during the reciprocating knitting process. The middle portion 4 comprises lateral sides 7, 8 that extend between the heel portion 2 and the toe portion 6 on either side. The footlet 1 is further provided with a first elastic band 9 located adjacent the heel portion 2 and a second elastic band 10 located adjacent the toe portion 6. A method for manufacturing such a footlet 1 is described in WO2008072048A1.

Figure 2:
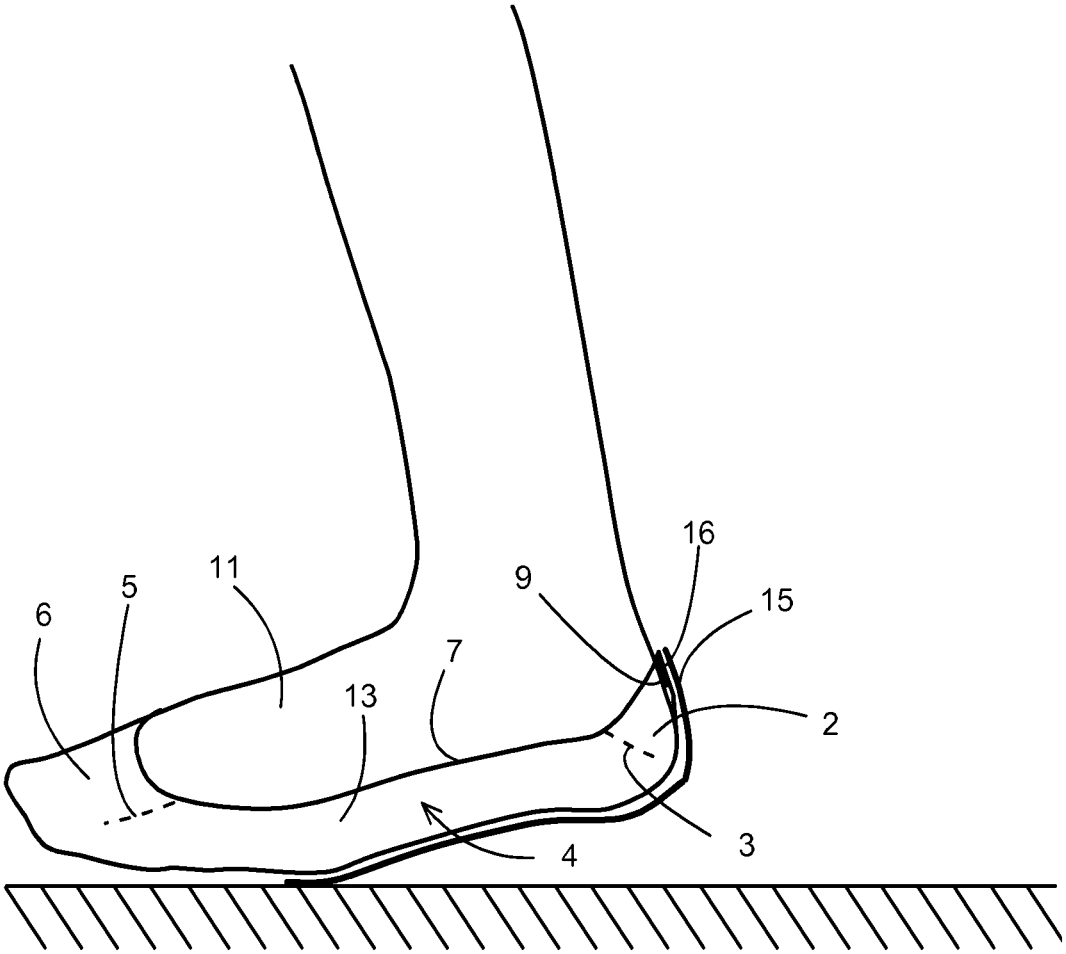
FIG. 2 is a side view of the footlet of FIG. 1 present on a person's foot, on which foot a shoe is worn.

FIG. 2 shows a person's foot 11 fitted with the footlet 1 of FIG. 1. The heel portion 2 is laid around the heel of the foot 11 here. The toe portion 6 lies over the toes of the foot 11. The middle portion 4 extends with a bottom portion 12 along the lower side of the foot 11 and with lateral portions 13, 14 along the lateral sides of the foot 11. The foot 11 with the footlet 1 present thereon is worn in a shoe 15, only part of which is shown for reasons of clarity.

Figure 3:
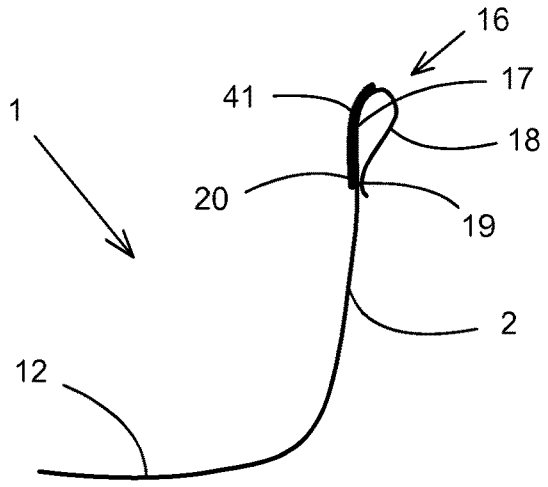
FIGS. 3, 4 and 5 are partial cross-sectional views of various embodiments of a heel portion of a footlet according to the invention.

FIG. 3 shows an embodiment of the footlet 1 in which the heel portion 2 is provided with a knitted folded elastic band 16. The elastic band 16 is folded in two, such that the elastic band 16 comprises a first band portion 17 facing the toe portion 6 and a second band portion 18 remote from the toe portion 6. When knitting of the elastic band 16 takes place, the second band portion 18 is knitted first and after that the first band portion 17. Once the first elastic band 17 has been knitted, the end 19 of the second band portion 18 is joined to the end 20 of the first band portion 17 by knitting. Then the remaining portion of the heel portion 2 and the footlet 1 is knitted.

Figure 4:
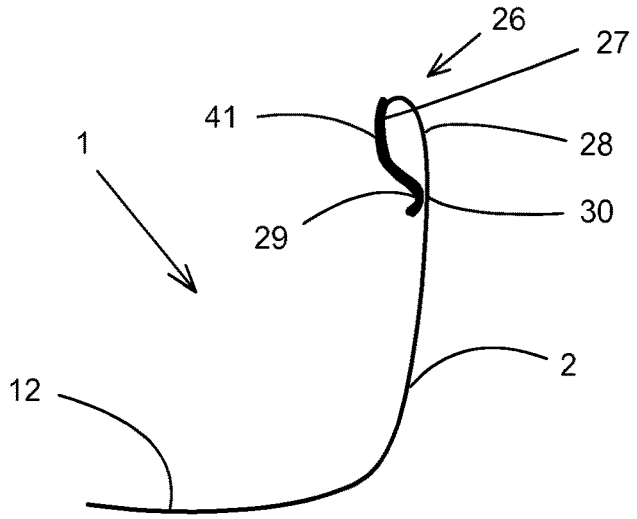

FIG. 4 shows 26 another embodiment of the footlet 1, in which the heel portion 2 is provided with a knitted, folded elastic band 26. The elastic band 26 is folded, comprising a first band portion 27 facing the toe portion 6 and a second band portion 28 remote from the toe portion 6. When knitting of the band 26 takes place, the first band portion 26 is knitted first and after that the second band portion 27. Once the second band portion 28 has been knitted, the end 29 of the first band portion 26 is joined to the end 30 of the second band portion 28 by knitting. Then the remaining portion of the heel portion 2 and the footlet 1 is knitted.

Figure 5:
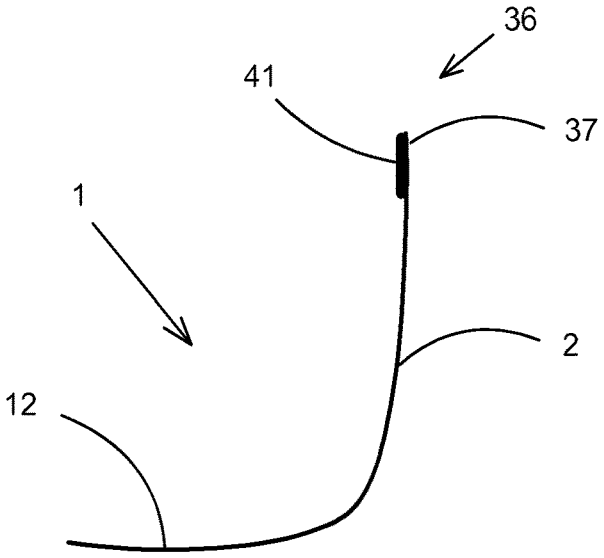

FIG. 5 shows another embodiment of the footlet 1, in which the heel portion 2 is provided with a knitted, single elastic band 36 which comprises a single elastic band portion 37.

The footlets 1 provided with elastic bands 16, 26, 36 as shown in FIGS. 3, 4 and 5 have been made entirely by reciprocating knitting, so that the footlet 1 does not have any stitched seams.

Figure 6:
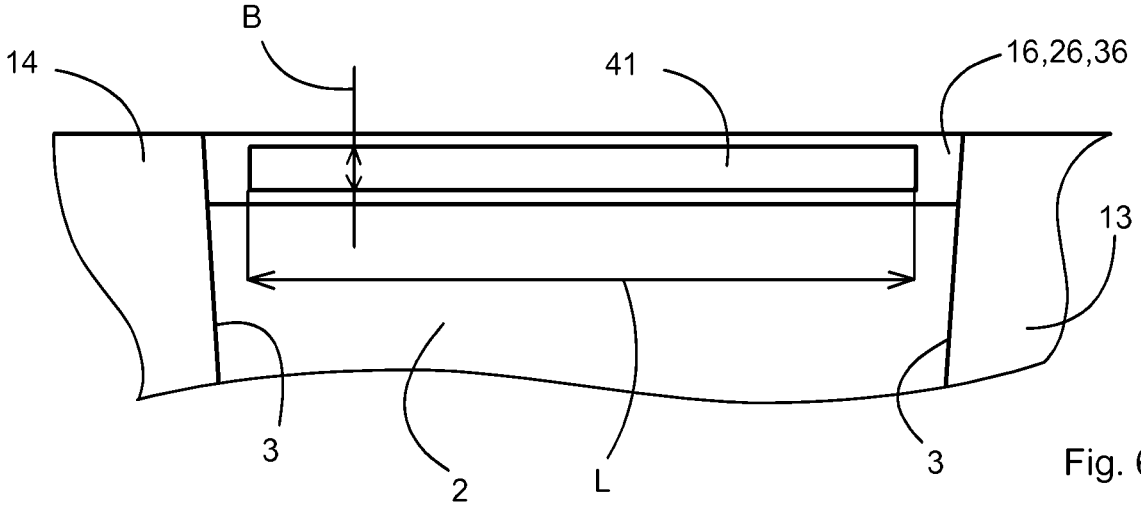
FIGS. 6, 7 and 8 are partial inside views of various embodiments of a heel portion of a footlet according to the invention.

The elastic bands 16, 26, 36 are each provided with an anti-slip element 41 (see FIG. 6) on a side facing the toe portion 4 (inner side). The anti-slip element 14 is made up of a layer of silicone on the inner side. The silicone is for example applied to the elastic band 16, 26, 36 by applying a stretching force to the elastic band 16, 26, 36, as a result of which the elastic band 16, 26, 36 is stretched from a starting length to a length 1.5-3 times greater than the starting length. Then a template (not shown) provided with an opening having a length of 6-7 cm, a width of 1-5 mm and a height of 0.2-0.5 mm, for example, is laid on the elastic band 16, 26, 36. Subsequently, the opening is filled with silicone. Once the silicone has bonded to the elastic band 16, 26, 36, the stretching force is released, allowing the elastic band 16, 26, 36 to return to its original starting length under the influence of its own elastic force. The anti-slip element 41 formed by the silicone will now have a length L of about 3-4 cm and a thickness and width B slightly greater than the height and the width of the opening in the template. In the case of a longer template, a greater length, for example of 7 cm or more, can be obtained.

Figure 7:
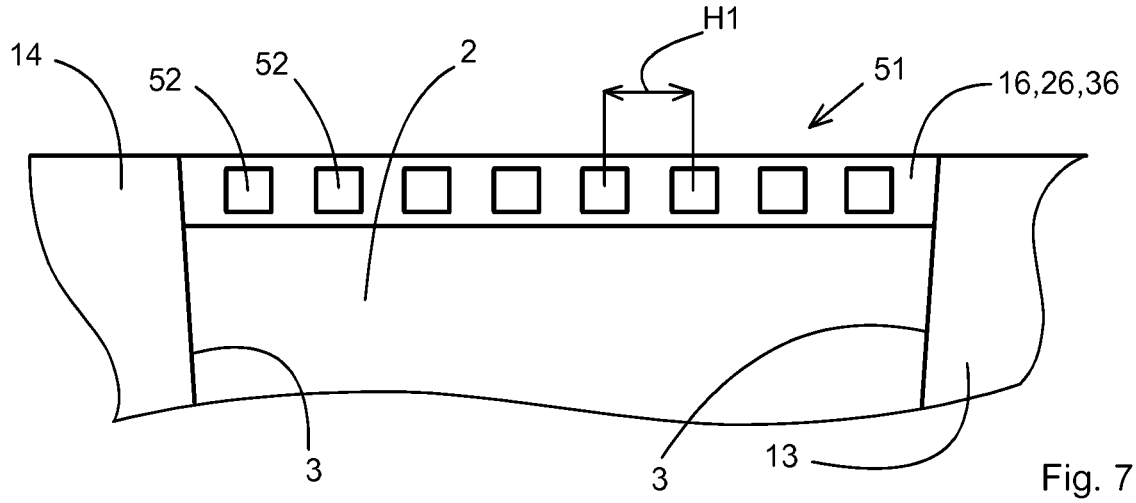

FIG. 7 shows another embodiment of the anti-slip element 51, which comprises a number of spaced-apart anti-slip parts 52. The anti-slip parts 52 have a square or rectangular shape and are spaced a distance H1 apart.

Figure 8:
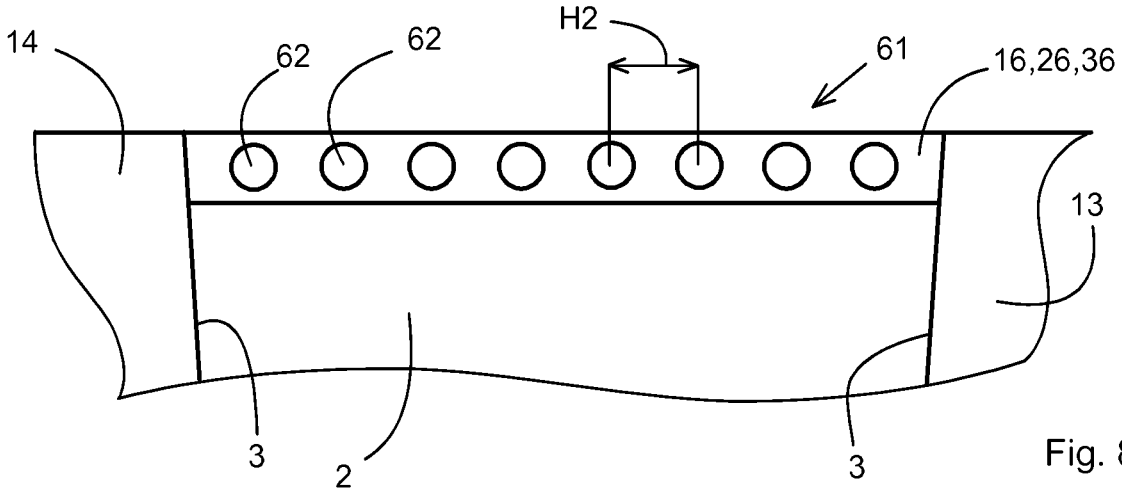

FIG. 8 shows another embodiment of the anti-slip element 61, which comprises a number of spaced-apart anti-slip parts 62. The anti-slip parts 52 have a circular shape and are spaced a distance H2 apart.

Because of the configuration with spaced-apart anti-slip parts 52, 62, the amount of silicone needed for forming the anti-slip element 51, 56 is smaller than the amount needed for forming the strip-shaped anti-slip element 41.

It is also possible for the anti-slip element to comprise a number of spaced-apart anti-slip parts having a different shape, for example a triangular shape. Triangular anti-slip parts are preferably arranged with a wide side facing up, so that relatively much material of the anti-slip element will be present at the upper side of the heel portion.

It is also possible to have the anti-slip element 41, 51, 61 also extend in part over a part of the heel portion 2 that is located under the elastic band 16, 26, 36.

The elastic band 16, 26, 36 is for example made of a polyurethane, such as elastane, lycra, creora or other elastic thread or fibre, or a combination with other threads. The remaining part of the knitted portion of the footlet 1 is knitted from fibres or threads of cotton, polyamides, polypropylene or another plastic or other material, or a combination thereof.

It is also possible to form only part of the footlet 1 by means of circular knitting. This has the disadvantage, however, that stitched seams are unavoidable.

The anti-slip element for example consists of silicone marketed by CHT, Dow Corning, Alpina or other companies, for example under the name of Alpatec.

Is also possible to use materials other than silicone, for example PVC, silicone-free Faitplast With Me, etc.

It is also possible to apply the anti-slip element in translucent form or in any desired colour.

It is also possible to apply the anti-slip element in the form of individual letters, a text or an image.

LIST OF REFERENCE NUMERALS

1. footlet
2. heel portion

3. line formed by knitting
4. middle portion
5. line formed by knitting
6. toe portion
7. lateral side
8. lateral side
9. band
10. band
11. foot
12. bottom portion
13. lateral portion
14. lateral portion
15. shoe
16. band
17. first band portion
18. second band portion
19. end
20. end
26. band
27. first band portion
28. second band portion
29. end
30. end
36. band
37. band portion
41. anti-slip element
51. anti-slip element
52. anti-slip part
61. anti-slip element
62. anti-slip part
L length
B width
H1 spacing
H2 spacing

The invention claimed is:

1. A footlet provided with a heel portion formed by knitting, a toe portion, and a middle portion located between the heel portion and the toe portion, the middle portion comprises lateral sides that extend between the heel portion and the toe portion on either side of the footlet, the heel portion, the lateral sides, and the toe portion forming an opening of the footlet, wherein the heel portion is provided with a knitted elastic band terminating at the lateral sides and forming an edge along the opening, characterised in that the elastic band is folded in two forming an inner layer and an outer layer of the elastic band that are joined together by knitting the inner layer and outer layer of the folded elastic band together, with the inner layer facing the toe portion and the outer layer remote from the toe portion, wherein the inner layer facing the toe portion is provided with an anti-slip element applied thereto, the anti-slip element applied to the inner layer and terminating with the inner layer of the elastic band at the lateral sides, wherein only the inner layer of the elastic band of the heel portion is provided with the anti-slip element applied thereto.

2. A footlet according to claim 1, characterised in that the anti-slip element comprises silicones.

3. A footlet of according to claim 1, characterised in that the anti-slip element is strip-shaped.

4. A footlet according to claim 1, characterised in that the anti-slip element comprises a number of spaced-apart anti-slip parts.

5. A footlet of according to claim 1, characterised in that the anti-slip parts are spaced 5-10 mm apart.

6. A footlet according to claim 1, characterised in that the anti-slip parts are block-shaped or strip-shaped.

7. A footlet according to claim 1, characterised in that the anti-slip element extends along a length of 2-7 cm over the elastic band.

8. A footlet according to claim 1, characterised in that the anti-slip element extends over the elastic band over a width of 2-6 mm transversely to the length.

9. A footlet according to claim 1, characterised in that the footlet is entirely made by reciprocating knitting and that subsequently the anti-slip element is applied to the elastic band.

10. A method for producing a footlet according to claim 1, characterised in that after at least the elastic band of the heel portion has been knitted, the elastic band is provided with the anti-slip element applied thereto on the side of the heel portion facing the toe portion.

11. A method according to claim 10, characterised in that the anti-slip element is applied to the elastic band by means of screen-printing, template printing, heat transfer or by means of a dispenser.

12. A method according to claim 10, characterised in that a stretching force is applied the elastic band prior to the application of the anti-slip element, as a result of which the elastic band is stretched from a starting length to a length 1.5-3 times greater than the starting length, and that subsequently the anti-slip element is applied, after which the stretching force is released.

13. A method according to claim 10, characterised in that the footlet is entirely made by reciprocating knitting, after which the anti-slip element is applied to the elastic band.

* * * * *